US008241023B2

(12) United States Patent
Wilhelm et al.

(10) Patent No.: US 8,241,023 B2
(45) Date of Patent: Aug. 14, 2012

(54) PUMPING UNIT WITH REINFORCING RIBS

(75) Inventors: Adam Wilhelm, Munich (DE); Peter Weber, Herrrsching (DE); Johann Rothkopf, Finsing (DE); Tamara Rothkopf, legal representative, Finsing (DE); Mehmet Gueluem, Markgroeningen (DE); Fevzi Yildirim, Gerlingen (DE); Thomas Wuensch, Ludwigsburg (DE); Reinhard Dittmann, Feldkirchen (DE)

(73) Assignee: Robert Bosch GmbH (DE)

( * ) Notice: Subject to any disclaimer, the term of this patent is extended or adjusted under 35 U.S.C. 154(b) by 576 days.

(21) Appl. No.: 12/444,058

(22) PCT Filed: Sep. 19, 2007

(86) PCT No.: PCT/EP2007/059896

§ 371 (c)(1),
(2), (4) Date: Apr. 2, 2009

(87) PCT Pub. No.: WO2008/040637

PCT Pub. Date: Apr. 10, 2009

(65) Prior Publication Data

US 2010/0008809 A1 Jan. 14, 2010

(30) Foreign Application Priority Data

Oct. 2, 2006 (DE) ..... 10 2006 046 828
Mar. 12, 2007 (DE) ..... 10 2007 011 792

(51) Int. Cl.
*F03C 4/00* (2006.01)
*F04C 15/00* (2006.01)
*F04C 2/00* (2006.01)

(52) U.S. Cl. ..... 418/133; 418/225; 417/410.4

(58) Field of Classification Search ..... 418/166, 418/171, 206.1, 131–133, 225; 417/410.4, 417/203

See application file for complete search history.

(56) References Cited

U.S. PATENT DOCUMENTS

| | | | | |
|---|---|---|---|---|
| 5,997,262 | A | 12/1999 | Finkbeiner et al. | |
| 6,666,670 | B1 * | 12/2003 | Hartman et al. | 418/133 |
| 6,695,604 | B1 | 2/2004 | Yu | |
| 2007/0003422 | A1 | 1/2007 | Yildirim et al. | |

FOREIGN PATENT DOCUMENTS

| | | | |
|---|---|---|---|
| DE | 19816173 | A1 | 10/1998 |
| DE | 10115866 | A1 | 10/2002 |
| DE | 10333190 | A1 | 2/2005 |
| JP | 58119959 | A | 7/1983 |

* cited by examiner

*Primary Examiner* — Theresa Trieu
(74) *Attorney, Agent, or Firm* — Ronald E. Greigg

(57) ABSTRACT

A pumping unit having a pump chamber with a rotor mounted in a rotatable manner within the chamber. The pumping chamber is formed by a circumferential wall and two end walls. The circumferential wall is formed on an annular collar of a pump part and has on its inner surface a track on which sealing bodies of a rotor roll. To avoid deformation of the pump part by hydraulic forces or by pressing-in forces, ribs are arranged on the outer surface of the circumferential wall which extend away from the pump chamber. A shoulder is arranged on the side of the end wall which is directed away from the pump chamber. The shoulder is connected by a press fit to the pump housing and has thin walls so that pressing forces do not result in any deformation to the end wall of the pump chamber.

16 Claims, 2 Drawing Sheets

PUMPING UNIT WITH REINFORCING RIBS

CROSS-REFERENCE TO RELATED APPLICATION

This application is a 35 USC 371 application of PCT/EP 2007/059896 filed on Sep. 19, 2007.

BACKGROUND OF THE INVENTION

1. Field of the Invention

The invention is based on a pumping unit.

2. Description of the Prior Art

A pumping unit is already known from DE 101 15 866 A1, with a pump chamber in which a rotor is supported in rotary fashion and which is formed by a circumference wall and two end walls. The circumference wall is embodied on an annular collar of a pump part and on the inside, constitutes a track along which the sealing elements of a rotor roll. A powerful compressive loading acts on the track of the pump chamber and when the pump part is composed of plastic, can lead to a deformation of the pump chamber, for example of the track, which results in an increased friction or a jamming of the rotor.

ADVANTAGES AND SUMMARY OF THE INVENTION

The pumping unit according to the invention has the advantage over the prior art that a deformation of the pump chamber due to hydraulic forces or press-fitting forces is avoided by providing ribs on the outside of the circumference wall oriented away from the pump chamber and/or by providing a shoulder for the press-fitting of the pump part into the pump housing, which shoulder is embodied with thin walls so that the pressing forces do not cause any deformation of the end wall of the pump chamber. The presence of the ribs according to claim 1 also reduces the area over which noise is transmitted from the track to the housing of the pumping unit. This improves the noise behavior of the pumping unit.

The ribs are advantageously situated in the axial region of the pump chamber and in this way, increase the strength of the circumference wall.

BRIEF DESCRIPTION OF THE DRAWINGS

An exemplary embodiment of the invention will be explained in greater detail in conjunction with the drawings, in which.

DESCRIPTION OF THE PREFERRED EMBODIMENT

Figure 1:
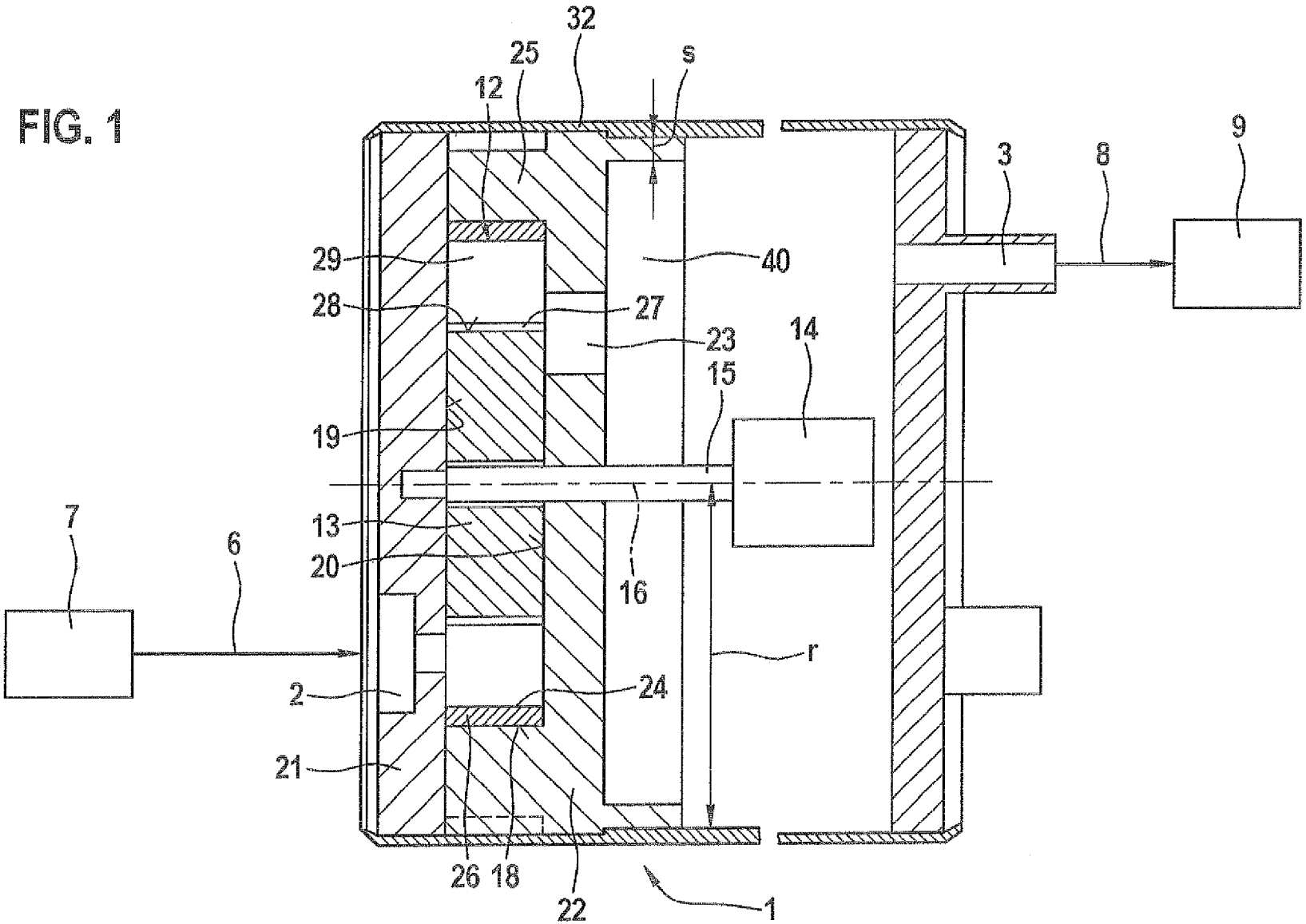
FIG. 1 shows a cross section through a pumping unit according to the invention and FIG. 2 is a view of the pump part according to the invention shown in FIG. 1.

FIG. 1 shows a cross section through a pumping unit according to the invention.

The pumping unit has a pump housing 1 with at least one inlet conduit 2 and one outlet conduit 3. The inlet conduit 2 of the pumping unit is connected, for example via a suction line 6, to a storage tank 7 used for storing fuel, for example. The outlet conduit 3 of the unit is connected via a pressure line 8 to an internal combustion engine 9, for example. The pumping unit is a rotary vane pump, whose functionality is know, for example, from DE 103 33 190 A1.

The pump housing 1 has a pump chamber 12 in which a rotor 13 is supported in an eccentric, rotary fashion. An actuator 14, for example an electric motor, drives the rotor 13 to rotate via a drive shaft 15. The pump chamber 12 is delimited by two end walls 19, 20 situated opposite each other in the direction of a rotor axis 16 and is delimited in the radial direction in relation to the axis 16 by a circumference wall 18 embodied in the form of a track. The first end wall 19 is embodied on the inside of a cover 21 oriented toward the rotor 13 and the second end wall 20 is embodied on the inside of the pump part 22 oriented toward the rotor 13. The circumference wall 18 is of one piece with an annular collar 25 of the pump part 22. The pump part 22 has at least one outlet 23 from the pump chamber 12.

The inside of the circumference wall 18 oriented toward the pump chamber 12 can be provided with a coating or a ring 26 that constitutes the track 24 for sealing elements 29 situated inside the rotor 13. It is also expressly possible for the circumference wall 18 itself to constitute the track 24.

On the circumference of the rotor 13, a plurality of grooves 27 is provided, which are distributed over the circumference of the rotor 13. The grooves 27 pass through the rotor 13 in the axial direction from one end surface of the rotor 13 to the other end surface. The grooves 27 each extend from the outer circumference toward the radial inside by means of two lateral flanks situated parallel to each other, for example, and end in a groove bottom 28 that is arc-shaped, for example. In each groove 27, a sealing element 29 is provided, which is embodied in the form of a cylindrical roller, for example. The sealing element 29 is supported in sliding fashion between the groove bottom 28 and the track 24. When the rotor 13 rotates, the sealing elements 29 are moved toward the track 24 and as a rule, rest against the track 24.

The cover 21 and the pump part 22 are encompassed by a cylindrical housing wall 32. The cover 21 and the pump part 22 are inserted into the housing 1 from its ends, the housing wall 32 being crimped and flanged at its end section oriented toward the cover 21 in order to support the cover 21 and the pump 22 securely in the housing 1.

Figure 2:
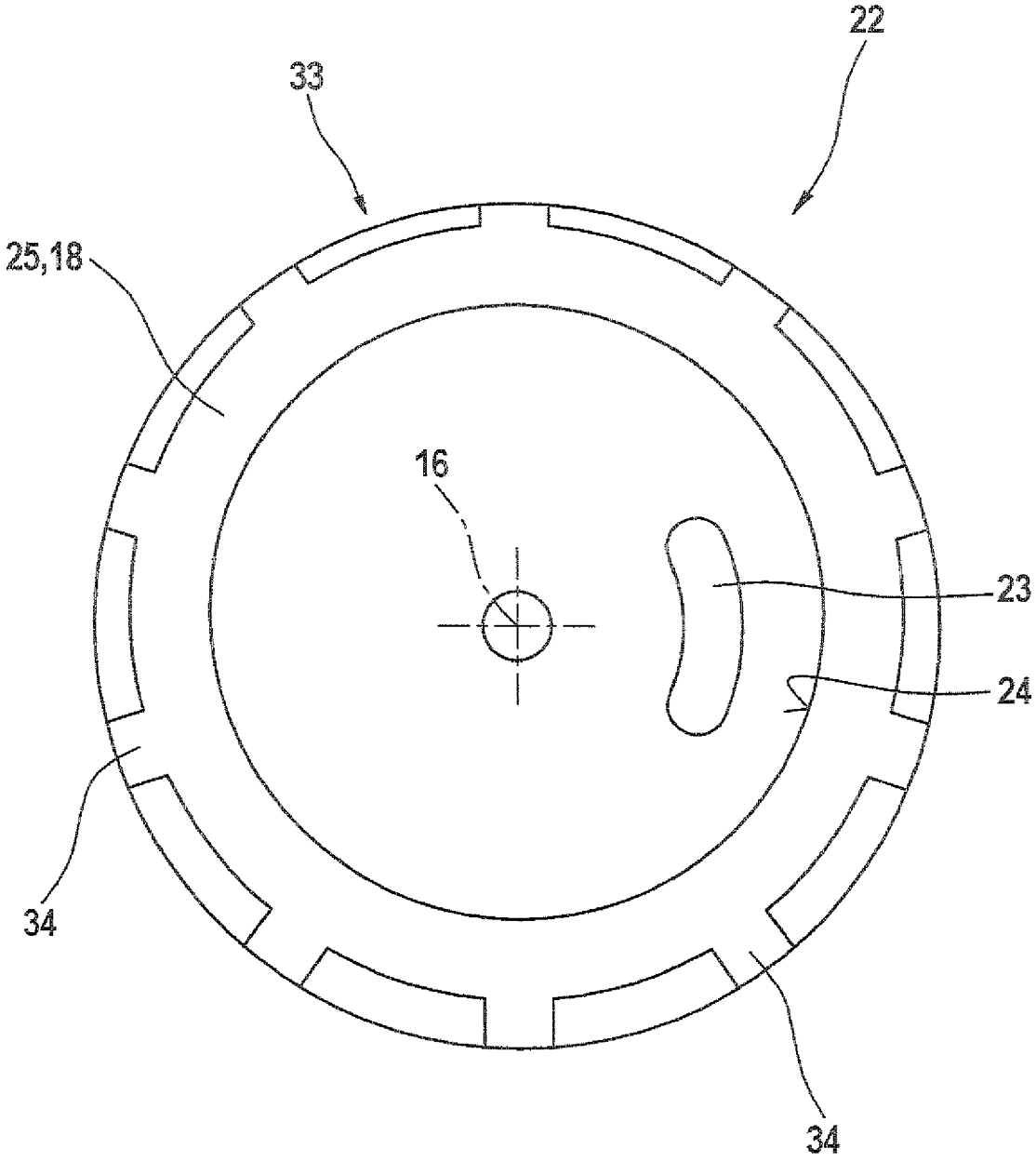

FIG. 2 shows a side view of the pump part according to the invention shown in FIG. 1.

Parts that remain the same or that function in the same manner as in the pumping unit according to FIG. 1 have been provided with the same reference numerals in the pump part according to FIG. 2.

The circumference wall 18 or the collar 25 with the track 24 is situated eccentrically in relation to the rotor axis 16. The housing 1 with the housing wall 32 is situated centrally in relation to the rotor axis 16. The circumference wall 18 or the collar 25 has a constant wall thickness, for example, over its circumference. In addition, the wall thickness of the circumference wall 18 or the collar 25 is embodied as comparatively thin in order to avoid a material accumulation and the formation of shrinkage cavities.

The cover 21 and/or the pump part 22 is manufactured, for example, out of plastic by means of injection molding.

According to the invention, ribs 34 are provided on the outside 33 of the circumference wall 18 or collar 25 oriented away from the pump chamber 12. The ribs 34 reinforce the strength of the circumference wall 18 or collar 25 so that the pump chamber 12 is not deformed by oscillations or by the hydraulic compressive loading of the pump chamber 12, but instead retains its predetermined shape.

The ribs 34 are situated in the axial region of the pump chamber 12, for example between the first end wall 19 and the second end wall 20. It is also expressly possible, however, for them to extend beyond the second end wall 20. For example, they extend for a predetermined length in the axial direction from the end surface of the pump part 22 oriented toward the cover 21. The ribs 34 extend in the radial direction in relation to the rotor axis 16, from the outside 33 of the circumference wall 18 to a housing wall 32.

Since the ribs 34 are provided between the circumference wall 18 or collar 25 and the housing 1 and since the circumference wall 18 or collar 25 is situated eccentrically in relation to the rotor axis 16, this results in a different radial height of the individual ribs 34.

The ribs 34 are distributed over the circumference of the circumference wall 18 or collar 25, for example uniformly or nonuniformly, and are spaced apart from one another in the circumference direction so that recesses are formed between them.

According to an alternative or optional exemplary embodiment, on the side of the pump part 22 oriented away from the pump chamber 12 and toward the actuator 14, at least one shoulder 40 is provided, which is connected to the cylindrical pump housing 1 in a frictionally engaging, nonpositive fashion by means of a press-fit and which is embodied as thin-walled so that the pressing forces introduced by means of the shoulder 40 do not cause any deformation of the end wall 20 of the pump chamber 12. This embodiment according to the invention prevents the end wall 20 of the pump chamber 12 from being deformed when the pump part 22 is press-fitted into the pump housing 1. Such a deformation could cause increased friction on the rotor 13 or could cause the rotor 13 to jam completely. The wall thickness s of the at least one shoulder 40 is smaller than the radius r of the pump housing 1 by a multiple, for example is 5 to 10 times smaller. The press-fit is chiefly situated in the region of the shoulder 40 and not in the region of the pump chamber 12 so that at most, the housing wall 32 of the pump housing 1 outside the region of the shoulder 40 exerts only slight forces on the pump chamber 12, but these forces do not result in any deformation of the pump chamber 12.

The at least one shoulder 40 is situated, for example, radially outside the pump chamber 12. For example, a single shoulder 40 is provided, which constitutes a closed ring. Alternatively, the annular shoulder 40 can also be discontinuous so that a plurality of partial-ring-shaped shoulders 40 are provided.

On the side oriented toward the pump housing 1, the at least one shoulder 40 has longitudinal ribs, not shown which have assembly bevels, for example.

The embodiment with the at least one shoulder 40 can be provided as shown in FIG. 1 in combination with the ribs 34 according to the invention. It is also expressly possible, however, to embody the at least one shoulder 40 according to the invention without embodying the ribs 34 according to the invention on the circumference wall 18, 25.

The foregoing relates to the preferred exemplary embodiment of the invention, it being understood that other variants and embodiments thereof are possible within the spirit and scope of the invention, the latter being defined by the appended claims.

The invention claimed is:

1. A pumping unit, comprising:

a pump chamber formed by a circumference wall and two end walls;

a rotor supported in rotary fashion in the pump chamber; and ribs provided on an outer periphery of the circumference wall oriented away from the pump chamber, wherein the ribs are embodied with different heights in a radial direction.

2. The pumping unit as recited in claim 1, wherein the ribs are situated in an axial region of the pump chamber.

3. The pumping unit as recited in claim 1, wherein the ribs extend in an axial direction in relation to a rotor axis.

4. The pumping unit as recited in claim 1, wherein the ribs extend in a radial direction in relation to a rotor axis from an outer periphery of the circumference wall to a housing wall.

5. The pumping unit as recited in claim 4, wherein the housing wall is situated centrally in relation to a rotor axis.

6. The pumping unit as recited in claim 1, wherein the ribs are distributed over an outer periphery of the circumference wall.

7. The pumping unit as recited in claim 1, wherein the circumference wall has a constant wall thickness over its circumference.

8. The pumping unit as recited in claim 1, wherein the circumference wall of the pump chamber is situated eccentrically in relation to a rotor axis.

9. The pumping unit as recited in claim 1, wherein the circumference wall has an inner periphery oriented toward the rotor that has a track for guiding sealing elements which are situated in grooves of the rotor.

10. The pumping unit as recited in claim 9, wherein the track for guiding the sealing elements is a coating or a ring.

11. The pumping unit as recited in claim 9, wherein the rotor has a circumference and the grooves arc distributed over the circumference of the rotor.

12. The pumping unit as recited in claim 11, wherein the sealing elements are embodied as rollers and the grooves pass through the rotor in an axial direction, each groove having a roller positioned therein.

13. The pumping unit as recited in claim 1, wherein one of the end walls is embodied on a side of a cover oriented toward the rotor and the other end wall is embodied on a side of a pump part oriented towards the rotor.

14. The pumping unit as recited in claim 13, wherein the circumference wall is embodied as an annular collar of the pump part.

15. The pumping unit as recited in claim 13, wherein at least one shoulder is provided on a side of the pump part oriented away from the pump chamber.

16. The pumping unit as recited in claim 15, wherein the at least one shoulder is situated radially outside of the pump chamber.

* * * * *